United States Patent [19]

McQueen

[11] Patent Number: 4,635,528

[45] Date of Patent: Jan. 13, 1987

[54] ADJUSTABLE FIREARM STABILIZER

[75] Inventor: Sidney J. McQueen, Albuquerque, N. Mex.

[73] Assignees: Continental Technology Corporation; Gerald Goodman, both of Albuquerque, N. Mex.

[21] Appl. No.: 750,074

[22] Filed: Jun. 28, 1985

Related U.S. Application Data

[63] Continuation-in-part of Ser. No. 560,574, Dec. 12, 1983, abandoned.

[51] Int. Cl.[4] ..... F41C 21/18

[52] U.S. Cl. ..... 89/14.3

[58] Field of Search ..... 42/75 B, 79; 89/14.05, 89/14.2, 14.3, 14.4, 14.5

[56] References Cited

U.S. PATENT DOCUMENTS

| | | | |
|---|---|---|---|
| 1,636,357 | 7/1927 | Cutts | 89/14.3 |
| 2,110,165 | 3/1938 | Moore | 42/75 B |
| 2,340,821 | 2/1944 | Russell | 42/79 |
| 4,392,413 | 7/1983 | Gwinn, Jr. | 89/14.3 |

*Primary Examiner*—Deborah L. Kyle
*Assistant Examiner*—Ted L. Parr
*Attorney, Agent, or Firm*—Pennie & Edmonds

[57] ABSTRACT

A stabilizer, for firearms which fire a single projectile from each shell, which is attached to the muzzle of the firearm to control muzzle climb during firing. The stabilizer is adjustable in both the magnitude and direction of the forces which counter muzzle climb. The stabilizer is able to be adjusted for the individual characteristics of the firer as well as varying powder loads in ammunition. A body of the stabilizer is attachable to the muzzle of the firearm so that gas vent slots and gas screen ports may be oriented from the vertical in any desired direction. An adjustable nose cap is threaded into the body any desired portion of the length of the body and the nose cap may cover or expose any of the gas vent slots or a portion of one of the gas vent slots thus controlling the space through which escaping gases may escape, and consequently controlling the magnitude of the force countering the muzzle climb. The stabilizer is readily adjustable in the field or on the firing range without carrying spare parts or replacement items.

4 Claims, 1 Drawing Figure

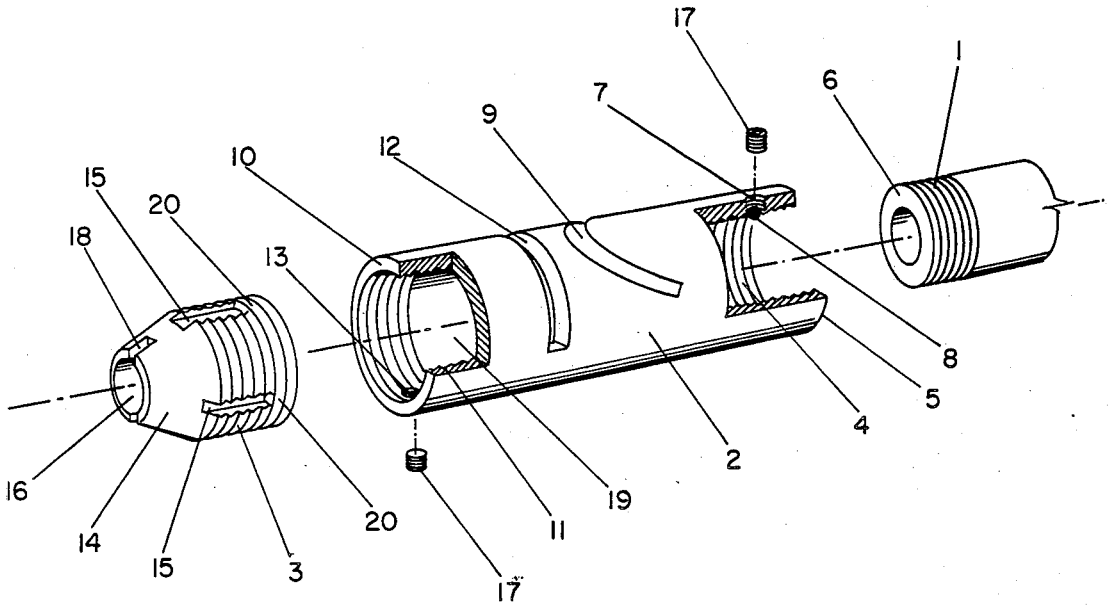
17
1
6
7
9
12
10
15
20
18
13
8
5
4
2
19
11
20
16
14
15
3
17

ADJUSTABLE FIREARM STABILIZER

This is a continuation-in-part application of application Ser. No. 560,574 filed Dec. 12, 1983, abandoned.

SUMMARY OF THE INVENTION

When a firearm is fired, the muzzle tends to climb. This tendency of a firearm to climb when it is fired is a complex result of the recoil forces acting on the human body of the firer, and the reaction of the firer to those forces. As a result every firer of a firearm will experience a different and unique amount of muzzle climb, because the firer's response both psychologically and physically will be unique. The invention is a device that enables the firer to direct a controlled amount of escaping gas from the muzzle of a firearm in a desired direction, so that the recoil force is effectively negated by the force caused by the directed escaping gases. Consequently, the firer can compensate, not only for the mechanics of the weapon and the ammunition, such as slug mass, powder charge and mass of the weapon, but the firer can also compensate for his own reactions. That is, the device can be tuned to the individual requirements of the firer. Indeed, as is common among self-loaders, the firer can with experience and practice adjust the device for each individual caliber and powder charge selected by the self-loader. The invention comprises a means for attaching the stabilizer to the muzzle of a firearm, a body which has one or more gas screen ports and one or more gas vent slots oriented transversely to the longitudinal direction of the body and being spaced with respect to each other, and a nose cap which mates with the body in such a fashion that the nose cap may be adjusted to open or close a portion or all of the gas vent slots. The body is attached to the firearm so that the orientation of the gas screen ports and the gas vent slots may be varied either left or right from the vertical toward either side in the desired angularity. Thus the magnitude and direction of the forces caused by the controlled escaping gases can be adjusted minutely to the smallest desire and whim of the firer.

BACKGROUND OF THE INVENTION

1. Field of the invention.

This invention relates generally to muzzle devices for firearms, and more particularly to adjustable, personalized stabilizers for firearms.

2. Description of the Prior Art.

Muzzle brakes for firearms have been utilized for many years. Probably one of the best known muzzle brakes is the Cutts Compensator which came into relatively wide use around 1930. The Cutts Compensator is described in CUTTS, U.S. Pat. No. 1,636,357. The Cutts Compensator as shown in the patent, has a body with slots through which the escaping gases are forced by the pressure in the body, and the slots are all slanted toward the rear of the weapon and toward the firer. The slots on the Cutts device are also in two general configurations. First the slots are all oriented so that they permit gas to escape in one direction such as vertical, or they are disposed about the body to permit the gas to escape in two directions namely horizontally and vertically. Mention is made in the text that the orientation of the Cutts device can be adjusted so that the direction of the force caused by escaping gases can be controlled. There are two distinct disadvantages to the Cutts Compensator. First, the gases escaping from the slots tend to be blasted to the rearward in and around the face and hands of the firer. Secondly, the amount of escaping gases can only be controlled by determining the size and number of slots to te cut into the body of the Cutts Compensator. There is no provision for adjusting for the amount of controlled escaping gases after the Cutts Compensator is manufactured. Two other patents typify the developments in the field of attachment to muzzles of firearms. Moore, U.S. Pat. No. 2,110,165 teaches a type of muzzle device for machine guns that enhances the rearward recoil in order to compensate for a massive bolt and barrel arrangement. The Moore teaching shows that a plug may be inserted in the end of the barrel of a weapon allowing the escaping gases to impinge thereon to enhance the recoil rather than to diminish or control the effects of recoil. Russell, U.S. Pat. No. 2,340,821 teaches an extension of the barrel inside of a compensatcr to provide rifling for shot guns. Russel's device is to provide a means to spread the shot pattern after the shot wad leaves the muzzle of the weapon by imparting a rotary motion to the shot wad. Russel did provide that his shot spreader could be slightly separated from the muzzle of the weapon so as to permit communication by the gases with the compensator in which the Russell device was installed. However, the communication is necessarily limited because the shot wad must not be permitted to substantially expand before entering the shot spreader. A device substantially different in principle, but which to a degree tends to accomplish the same objectives as the present invention is taught by Gwinn, U.S. Pat. No. 4,392,413. Gwinn uses two chambers into which gas is trapped and permitted to escape under designed conditions.

BRIEF DESCRIPTION OF THE DRAWING FIG. 1 is an isometric exploded view of the invention.

DESCRIPTION OF THE PREFERRED EMBODIMENT

The invention, a stabilizer for firearms, is limited to firearms that fire one projectile at each firing, as contrasted to a shotgun, for reasons that will become obvious and will be explained hereinafter. FIG. 1 shows the invention to be comprised of a means for attaching 1, a body 2, and a nose cap 3. The attaching means 1 may be any convenient means for attaching the body 2 to the muzzle 6 of a firearm. As shown the muzzle 6 of the firearm and the body 2 are generally cylindrical in shape with the body 2 having an inside diameter such that when threaded, will mate with the external threads on the muzzle of a firearm. The attaching means 1 is shown in FIG. 1 to consist of simple internal threads 4 which permit screwing of the stabilizer onto the muzzle 6 of a firearm, and a set screw hole 7, with a lead pellet 8 in the bottom thereof, through the body in the vicinity of the threads 4 such that when the body 2 is affixed to the muzzle 6 of the firearm, a set screw 17 may be screwed into the set screw hole 7 bearing against the lead pellet 8 locking the body 2 onto the muzzle 6 without substantial wear on the threads on the muzzle 6 of the firearm. The location of the set screw hole 7 radially around the longitudinal axis of the body 2 defines the top of the body 2, and the rear end 5 of the body 2. The other end of the body 2 is designated the forward end 10. Adjacent to the set screw hole 7 and toward the forward end 10 is first, one or more gas screen ports 9. The gas screen ports 9 are angled away from the vertical and slant, from the inside surface of the body 2 to the exterior surface of the body 2, toward the front end 10. The gas screen ports 9 are slots cut through the wall of the body 2, providing a communication from the interior of the body 2 to the outside atmosphere. Forward toward the front end 10 of the body 2 of the gas screen ports 9, yet adjacent to the gas screen ports 9 on the top of the body 2 are a plurality of gas vent slots 12. The gas vent slots 12 are arranged parallel to each other and are arcuate slots cut perpendicular to the longitudinal axis of the body 2. The slots are cut through the body 2 so as to provide a gas communication from the interior of the body 2 to the outside atmosphere. The gas vent slots 12 are sized according to the caliber of the ammunition to be fired in the firearm. The front end 10 of the body 2 is also threaded internally to mateably accept the nose cap 3. The nose cap 3 is shown to be in the general shape of a plug which has external threads to mate with the internal adjusting threads 11 in the front end 10 of the body 2. The nose cap 3 has a center hole 16 the center of which is on the longitudinal axis of the bore of the firearm, and the center hole 16 is sized to the same or slightly larger diameter as is the bore diameter of the barrel of the firearm. The front end 10 of the body 2 has a set screw hole 13 through the area of the internal adjusting threads 11 in the bottom of the body 2. The nose cap 3 when threaded into the front end 10 of the body 2 extends as desired into the interior of the body 2, thus forming with the body 2 a chamber 19 between the muzzle 6 of the firearm and the nose cap 3. The nose cap 3 is locked into the desired position by another set screw 17 inserted into the set screw hole 13 which bears against the nose cap 3 in slots 15 provided at desired locations around the nose cap 3 partially but not totally the longitudinal length of the threads on the nose cap 3. A portion of the threads which does not have a slot 15 is designated portion 20. This portion 20 provides a seal to the chamber 19 within the body 2. When the firearm is fired, the bullet emerges from the muzzle 6 and passes through the chamber 19 and then through the center hole 16 in the nose cap 3 on its way to the target. However, for the instant that the bullet is within the center hole 16, the bullet forms a loose seal in the chamber 19 allowing very little gas to escape through the center hole 16. The gases from the exploding cartridge which are following the bullet enter the chamber 19 and the pressure therein rises very rapidly forcing some of the gases out the gas screen ports 9 and substantially more of the gases out the gas vent slots 12. The gases escaping from the gas screen ports 9 and the gas vent slots 12 cause a force on the body 2 opposite to the direction of movement of the escaping gas. The body 2 can be adjusted in angularity with respect to the muzzle 6 of the firearm, and thus with respect to the entire firearm and therefore the direction of the force caused by the escaping gas can be controlled and directed to counter the normal climb of the muzzle 6. The nose cap 3 is fashioned with screw driver slots 18 at the very exit of the center hole 16, to enable the firer to screw the nose cap 3 into the body 2 as far as desired. The nose cap 3 can effectively cover the gas vent slots 12 and reduce the volume of the chamber 19. Thus, the size of the chamber 19 and the effective number and size of exits for the gas to escape can be controlled. This provides a direct control over how much gas can escape through the gas vent slots 12 and the gas screen ports 9. Thus, the stabilizer controls not only the direction but the magnitude of force that will counter the recoil forces. The gas screen ports 9 also perform another very useful function. If the gas vent slots 12 alone were used to vent gas from chamber 19, the hot gases would in a very short time arrive at the face and hands of the firer, causing great discomfort if not burns. The gas screen ports 9 permit and force escaping gases to flow forward away from the firer, and these forward flowing gases mix with the vertically rising gases from the gas vent slots 12 causing the entire escaping gas mass to have a generally forward movement away from the firer.

To appreciate the stabilizer and to use it effectively, it is necessary to understand the mechanics of muzzle climb. Muzzle climb is caused primarily by reaction forces from a bullet being fire, acting on the human body of the firer. The human body is and acts like a flexible platform. Two distinct motions combine to cause muzzle climb. First, because the weapon is fired from the firer's shoulder, waist, or some other freehand position, but almost invariably from one side of the firer, not directy in front of the firer's torso. This gives the weapon a moment arm, and the recoil forces acting through this moment arm cause a twisting of the firer's body about its vertical axis. The other motion is caused by the fact that the firer is usually standing on his feet, and the recoil forces act through the firer's shoulder, waist, or arms and the torso is bent rearwards because of the firer's flexible back and legs. The firer may and probably will react, somewhat belatedly, to the impulse of the forces and in all likelihood over react. Indeed, the likelihood that even an experienced firer can reactively compensate accurately for the impulse type forces, and do so on a repetitive basis is a function of extreme skill and proficiency seldom attained. And even an expert when firing under other than ideal conditions will find it difficult to be extremely accurate. With the stabilizer, and a little practice, the firer can take the guess work out of compensating and find the exact amount and direction of compensating force required for himself. It is now obvious that the amount and direction of compensating forces varies with the weight, strength, and skill of the individual firer, and will vary with the charge with which a shell is loaded. The stabilizer can be fine tuned to the desires of the firer and the conditions of fire.

I claim:

1. An adjustable stabilizer for firearms which fire a single projectile from each shell, comprising:

a means for attaching a body of the stabilizer to a muzzle of a firearm, and the body of the stabilizer being generally hollow and cylindrical in shape having a rear end and a forward end and said body having one or more gas screen ports adjacent to the rear end, and said gas screen ports being slots cut in the top of the body through to the interior of the body to provide a gas communication with the exterior atmosphere, said gas screen ports being cut at a slant from the interior of the body to the exterior of the body toward the front end of the body from the rear end of the body so that gas escaping from inside the body flows toward the exterior front end of the body, and said body having gas vent slots cut perpendicular to the longitudinal axis of the body from the exterior of the body to the interior of the body so as to provide a gas communication from inside the body to the outside of the body, said body being internally threaded at the front end to accept an externally threaded nose cap, and wherein the body has on its front end at the bottom a set screw hole, and the externally threaded nose cap having a center hole along the longitudinal axis of the bore of the firearm, said center being hole sized to have the same or slightly larger diameter as the bore of the firearm, and the external threads of the nose cap having partial longitudinal recesses, but a portion of the threads being completely circumferential, and wherein a set screw is threaded through the set screw hole in the bottom of the front end of the body and wherein the said set screw is screwed into the partial recess thereby locking the nose cap into the desired position, and wherein the nose cap has in the forward most surface across the center hole screw driver slots to enable the firer to screw the nose cap in or out of the body, and wherein the nose cap can be screwed into the body to any desired position thereby covering or closing gas vent slots as desired and forming a chamber within the body wherein the completely circumferential portion of the threads on the nose cap provide a seal for the chamber, and wherein the gases which trail a bullet as it exits the muzzle of a firearm fill the chamber, and wherein the bullet as it passes through the center hole in the nose cap substantially seals said chamber and the pressure therein rises rapidly causing the gases to exit the chamber through the gas screen ports and the exposed gas vent slots causing a force on the body in the direction opposite the direction of gas flow, and wherein the amount of gas flow exiting the gas screen ports and gas vent slots is controlled by the number and size of gas vent slots and gas screen ports left exposed, and wherein the attaching means enables the body to be attached to the muzzle of a firearm with the gas screen ports and gas vent slots oriented radially around the longitudinal axis of the barrel of the firearm in any desired direction.

2. The stabilizer of claim 1 wherein the means for attachment of the body to the muzzle of the firearm comprises:

threading the internal surface of the body at the rear end and providing a set screw hole at the top of the body adjacent to the rear end, and placing a lead pellet in the bottom of the set screw hole at the rear end of the body, and wherein the body may be threadably mated to the muzzle of the firearm, and the body oriented so that the gas screen ports and gas vent slots are facing in the desired direction, and wherein a set screw is threaded into the set screw hole at the rear end of the body and screwed until the set screw bears against the lead pellet which in turn bears against the threads on the muzzle of the firearm, minimizing any damage to the threads on the muzzle and securing the body to the muzzle at the desired angularity with respect to the firearm.

3. The stabilizer of claim 1 wherein the body has only one gas screen port and one or more gas vent slots.

4. The stabilizer of claim 1 wherein the body has more than one gas screen ports and one or more gas vent slots.

* * * * *